United States Patent [19]

Takaoka et al.

[11] 4,046,204

[45] Sept. 6, 1977

[54] CONTROLLED DIRECTIONAL DRILLING TOOL

[75] Inventors: Sabro Takaoka; Akira Shinoda; Hideo Kobayashi, all of Tokyo, Japan

[73] Assignee: Agency of Industrial Science & Technology, Tokyo, Japan

[21] Appl. No.: 744,393

[22] Filed: Nov. 23, 1976

[30] Foreign Application Priority Data

Nov. 25, 1975 Japan ..... 50-140915

[51] Int. Cl.[2] ..... E21B 7/08; E21B 3/08

[52] U.S. Cl. ..... 175/76

[58] Field of Search ..... 175/76, 104, 107

[56] References Cited

U.S. PATENT DOCUMENTS

| | | | |
|---|---|---|---|
| 2,796,234 | 6/1957 | Mann | 175/76 |
| 3,888,319 | 6/1975 | Bourne, Jr. et al. | 175/76 |
| 3,930,545 | 1/1976 | Sears | 175/76 |
| 3,974,886 | 8/1976 | Blake, Jr. | 175/76 |

*Primary Examiner*—James A. Leppink
*Attorney, Agent, or Firm*—Kurt Kelman

[57] ABSTRACT

A controlled directional drilling tool is disclosed which comprises a drilling unit consisting of a drilling head incorporating therein a rotary drill bit and bit-driving means and a drilling rod having said drilling head connected freely flexibly to the leading end thereof, a pair of cylinder means adapted to be operated by means of compressed air and a pair of direction-controlling rollers adapted so as to be caused, by the operation of said cylinder means, to protrude at mutually staggered positions from the opposite lateral sides of the drilling unit, said pair of cylinder means and said pair of direction-controlling rollers both provided to the drilling head of said drilling unit, whereby the direction in which the drilling is being made by said drilling head is changed as required by adjusting the protrusion of said pair of rollers.

4 Claims, 4 Drawing Figures

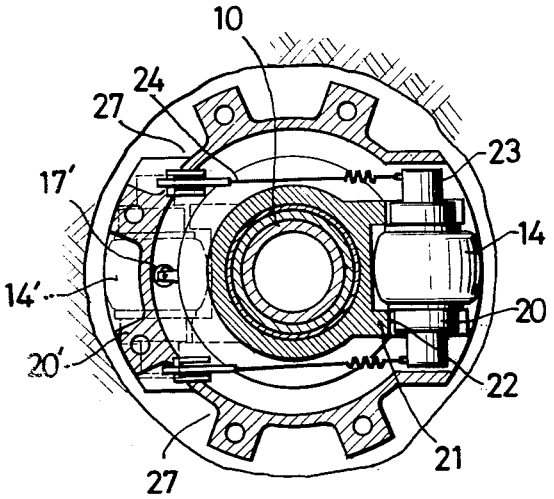
Fig. 3
Fig. 4
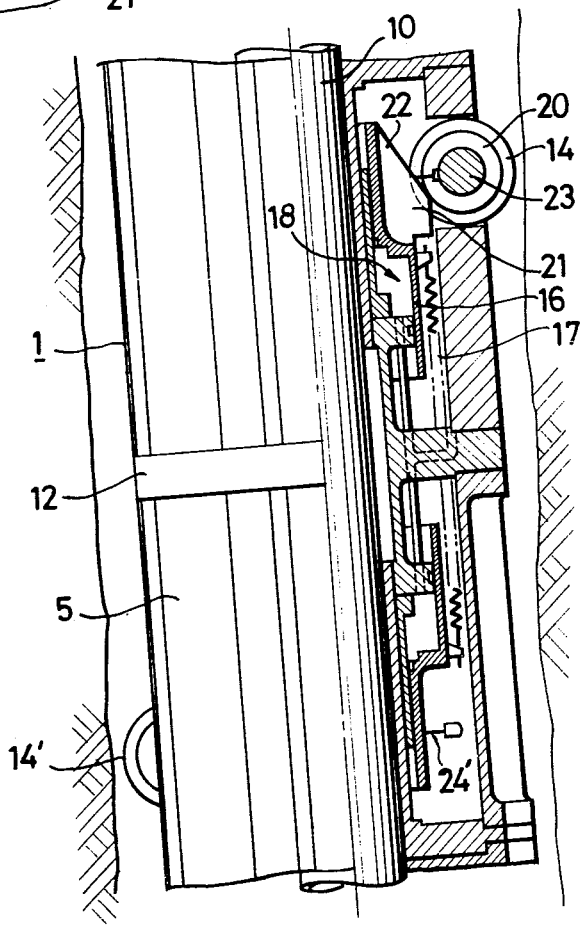

CONTROLLED DIRECTIONAL DRILLING TOOL

BACKGROUND OF THE INVENTION

This invention relates to a controlled directional drilling tool.

Holes are drilled into coal beds or rock beds for the purpose of withdrawing entrapped gases, surveying the earth's crust, etc. In the course of such drilling, there may arise necessity for changing the direction of drilling by reason of geological conditions or drilling conditions.

When there arises necessity for changing the direction of drilling while the drilling is in progress it has been customary to effect the required change by drawing the drilling tool out to the surface, separating the drill pipe and the drill bit, then re-joining them through the medium of a sub bent by the angle required for the control of the drilling direction and resuming the drilling operation.

U.S. Pat. Nos. 2,796,234 and 2,891,769 disclose directional drilling tools. The tool of the former disclosure is based on a method such that required directional drilling is obtained by hydraulically causing arms and rollers to protude to a controlled extent from a drill pipe. The tool of the latter disclosure has a drill pipe provided at separated levels with two guide means each consisting of four guide runners, whereby required control of the drilling direction is accomplished by causing the individual guide runners to protrude from their respective resting position to extents controlled by suitable hydraulic means.

In these directional drilling tools, however, the hydraulic pressure for causing the revolution of the drill bit and that for effecting the protrusion of arms, rollers or guide runners issue from a common source. Consequently, the hydraulic systems in the tools are inevitably complicated. Further, since the arms, rollers or guide runners always protrude from the surface of the drill pipe, they tend to sustain damage where the holes drilled by the tools happen to be small in diameter. Moreover, because of the existence of such protruding articles there is not only the possiblity of malfunction but the danger of the preventing bending when it is desired and inducing bending when it is not desired.

An object of the present invention is to provide a controlled directional drilling tool which permits the direction of drilling to be changed certainly to a new desired direction by an extremely simple mechanism.

SUMMARY OF THE INVENTION

To attain the object described above according to the present invention, there is provided a controlled directional drilling tool which has the basic construction of a drilling tool consisting of a drilling head incorporating therein a rotary drill bit and bit-driving means and a drilling rod having said drilling head freely flexibly attached to the leading end thereof and which additionally comprises a pair of pneumatically operatable cylinder means, a pair of piston members each possessed of an inclined portion at the leading end thereof and a pair of rollers held in contact with the inclined portions of said pair of piston members and freely protrusibly drawn back past the surrounding surface at a prescribed distance from each other in the lateral sides of the drilling head opposite each other across the axis of said drilling head, with said pair of cylinder means and said pair of piston members both provided to said drilling head.

By delivering the compressed air for drilling through the drilling rod to the bit-driving means, the drill bit disposed at the leading tip of the drilling head rotates and drills a hole in the mineral bed. If, in the course of the drilling operation, the direction of drilling must be changed, the required change in the drilling direction is accomplished by delivering the compressed air for control of the direction to the pair of cylinder means for thereby causing the piston members to advance and consequently permitting the inclined portions at the leading ends thereof the release the pair of rollers from their folded position in the lateral sides of the drilling head, with the respective rollers brought into pressing contact with the inner wall of the hole already drilled so as to have the drilling head inclined by an angle proper for the desired change of direction.

The controlled directional drilling tool of the present invention has a construction such that the pair of rollers are caused to protrude at mutually staggered positions from the opposed lateral sides of the drilling head by the operation of the pair of cylinder means and the pair of piston members as described above. Besides, the compressed air for drilling and that for control of the direction are supplied separately of each other. Thus, the tool itself has a simple construction and yet provides certain operation.

The other objects and other characteristics of the present invention will become apparent from the description to be given in detail hereinbelow by reference to the attached drawing.

BRIEF DESCRIPTION OF THE DRAWING

FIG. 3 is a sectional view taken along the line IV—IV in FIG. 2.

FIG. 4 is an explanatory diagram illustrating the condition in which the direction of drilling is changed in the drilling operation by use of the drilling tool of this invention.

DESCRIPTION OF THE PREFERRED EMBODIMENTS

Figure 1:
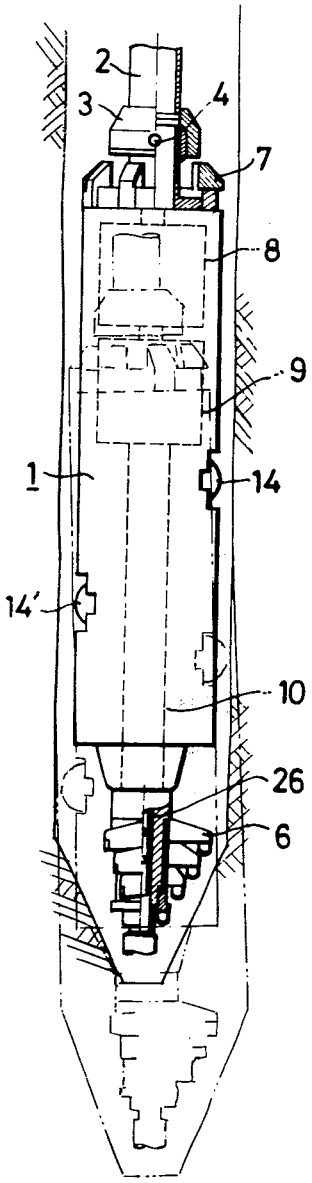
FIG. 1 is a partially sectioned view illustrating one preferred embodiment of the controlled directional drilling tool of this invention.

Referring to the accompanying drawings, in the controlled directional drilling tool of this invention, a drilling head 1 is connected to the leading end of a drilling rod 2 through the medium of a universal joint 3 which is rendered freely flexible by a pin 4 in any direction in which the head is to be bent. This drilling head 1 is provided at the leading end of the main body 5 of the drilling head with a rotary drill bit 6 and at the tail end thereof with a rear bit 7. Said main body 5 is internally provided with pneumatic driving means 8 such as an air motor operated by the compressed air for drilling and speed reducing means 9 serving to slow the rotation of said pneumatic driving means 8. Said drill bit 6 is stationarily fastened to the leading end of a rotary shaft 10 connected via said speed reducing means 9 to said driving means 8.

Figure 2:
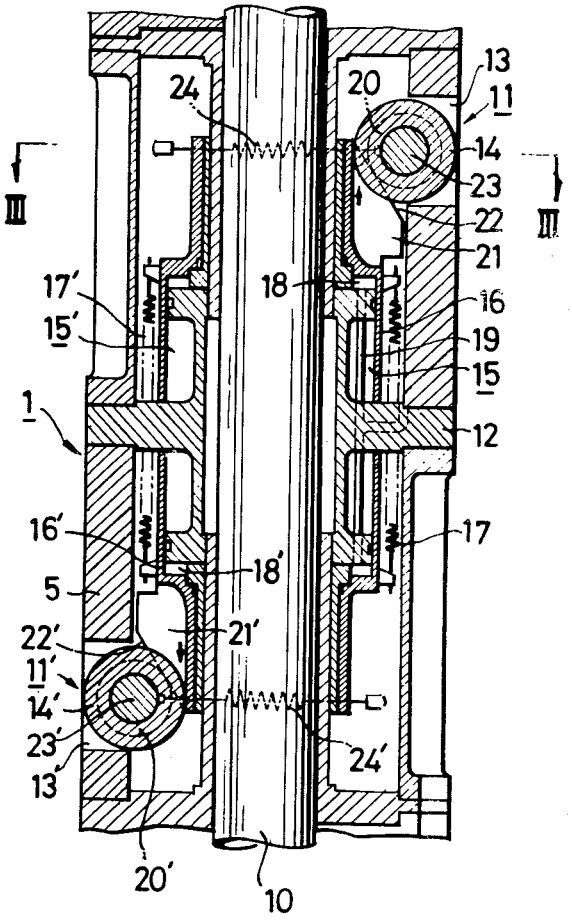
FIG. 2 is a partially sectioned enlarged view of a drilling head of the drilling tool of FIG. 1.

As illustrated in FIG. 2, first direction controlling means 11 adapted to effect a required change in the direction of drilling in the course of a drilling operation is disposed on one lateral side of said drilling head 1 and second direction controlling means 11' similarly adapted is disposed on the opposite lateral side of the drilling head 1 at a position staggered by a fixed distance from that of the first direction controlling means 11. In other words, the pair of direction controlling means 11, 11' are composed of rollers 14, 14' freely protrusibly disposed inside cavities 13, 13' formed on opposite sides at positions separated in opposite directions by a fixed distance from the center wall 12 forming part of the drilling head 5 and cylinder means 15, 15' serving to force said rollers out of the cavities. The cylinder means 15 serving the first direction controlling means 11 is provided with a cylinder 17 freely slidably set in a piston-like portion 16. A feed hole 19 for the compressed fluid for direction controlling opens into a cylinder chamber 18 which comprises said piston-like portion 16 and said cylinder 17. At the leading end of said cylinder 17, there is disposed a press member 21 which is provided with an inclined portion 22 adapted so that when the cylinder 17 is moved in the direction of the arrow by the pressure of the air delivered under pressure into the cylinder chamber 18, said inclined portion 22 will collide into the auxiliary rollers 20 disposed on both sides of the roller 14 and exert pressure and cause the roller 14 to thrust out of the cavity 13.

The cylinder means 15' of the second direction controlling means 11' and said cylinder means 15 are symmetrically disposed with respect to the center wall 12 and the cylinder means 15' has a mechanism similar to that of the roller 14, however, the press member 21' is embedded at one end thereof to a rotary shaft 10 and provided at the other end thereof with an inclined portion 22' so that the inclined portion 22' will collide into the auxiliary rollers 20' of the roller 14'. The roller shafts 23, 23' of the aforementioned direction controlling roller 14, 14' are supported in position respectively by the resilient springs 24, 24' laid taut against the main body of the drilling head 5. The compressed air for direction controlling is delivered, separately of the compressed air for drilling operation, from the feed pipe of a small diameter (not illustrated) disposed along the drilling rod 2 through the hole formed in one lateral portion of the main body 5 of drilling head 1 into said feed hole 19.

At the leading end of the drilling head 1 opens a nozzle 26 (see FIG. 1) for projecting the water which is delivered from the water feed pipe (not illustrated) laid along the drilling rod 2 via the rotary shaft 10. On the outer face of the main body 5 of the drilling head is disposed a longitudinal groove 27 intended to form a duct for discharging the water which has projected out of said nozzle 26, served to cool the drilling bit 6 during the drilling operation and is now carrying the slime resulting from the drilling.

With the controlled directional drilling tool of the present invention having the construction as described above, the desired drilling is accomplished by operating the driving means by delivering under pressure the compressed air for drilling via drilling rod 2 and thereby causing the driving means 8 to rotate the rotary shaft 10 and consequently rotate the drilling bit 6 attached to the leading tip thereof. When necessity arises for changing the direction of drilling, the compressed air for direction controlling is delivered under pressure from the feed pipe 19 to the cylinder compartments 18, 18'. The compressed fluid thus delivered causes the cylinder 17, 17' to move respectively in the directions shown by the arrows, with the result that the inclined portions 22, 22' of the press members 21, 21' collide into and push away the auxiliary rollers 20, 20'. Consequently, the direction controlling rollers 14, 14' are thrust out of their respective cavities 13, 13' until they come into contact with the surface of the hole which has been drilled. The force with which said controlling rollers 14, 14' press the surface of the hole causes the leading tip of the drilling head 1 to generate a moment in the direction indicated by the arrow, effecting a desired change in the direction of drilling. (FIG. 4)

In this case, the rotation of the drilling head 1 is suspended during the change of drilling direction because the drilling head 1 is joined by a joint 3 so as to be freely flexible in any direction in which the change of direction is made and, at the same time, the drilling bit 6 is rotated by means of the driving means 8 disposed inside the drilling head 1. Thus, the drilling direction of the drilling head 1 can be changed to a predetermined direction by virtue of the protrusion of said direction controlling rollers 14, 14'.

When the delivery of the compressed air for direction controlling is discontinued, the cylinders 17, 17' are caused to return to their original positions by the resiliency of the resilient springs and the direction controlling rollers 14, 14' are also returned to their withdrawn positions inside the openings 13, 13' by the resilient springs 24, 24'. Consequently, the drilling head 1 is allowed to advance straight in the newly determined direction.

As described above, the controlled directional drilling tool of this invention can effect a required change in the direction of drilling by means of direction controlling means of a very simple mechanism. Further it enjoys certain operation of the direction controlling means because the compressed air for drilling operation and that for direction controlling are delivered via separate routes.

What is claimed is:

1. A controlled directional drilling tool comprising in combination:

a drilling rod, a joint freely flexibly connected to one end of said drilling rod, a drilling head connected to the remaining end of said joint and provided at the leading end thereof with a drilling bit and in the interior thereof with a driving means for said drilling bit, a pair of cylinder means and a pair of piston members both disposed inside said drilling head, said piston members each possessed of an inclined portion at the leading end thereof, a pair of rollers disposed in contact with the inclined portions of said pair of piston members, said pair of rollers being disposed on the lateral sides of the drilling head opposite each other across the axis of said drilling head at positions separated by a prescribed distance and said rollers being freely protrusibly drawn in below the surrounding surface of the drilling head, and means for delivering compressed fluid to the cylinder means.

2. The controlled directional drilling tool according to claim 1, wherein the compressed air for use in the bit driving means and the compressed air for use in the cylinder means are delivered through paths formed independently of each other.

3. The controlled directional drilling tool according to claim 1, wherein the inclined portions at the leading ends of piston members are held in contact with the roller shaft.

4. The controlled directional drilling tool according to claim 1, wherein the roller means are stowed inside the drilling head by means of springs.

* * * * *